US008534587B2

(12) United States Patent
He

(10) Patent No.: US 8,534,587 B2
(45) Date of Patent: Sep. 17, 2013

(54) AUTOMATIC POSITIONING WINDER

(71) Applicant: Lizhi He, Dongguan (CN)

(72) Inventor: Lizhi He, Dongguan (CN)

( * ) Notice: Subject to any disclaimer, the term of this patent is extended or adjusted under 35 U.S.C. 154(b) by 0 days.

(21) Appl. No.: 13/712,945

(22) Filed: Dec. 12, 2012

(65) Prior Publication Data

US 2013/0099044 A1 Apr. 25, 2013

Related U.S. Application Data

(62) Division of application No. 12/936,515, filed on Oct. 5, 2010.

(51) Int. Cl.
*B65H 75/48* (2006.01)

(52) U.S. Cl.
USPC ..... 242/378; 242/378.1; 242/378.2; 242/378.3

(58) Field of Classification Search
USPC ..... 242/378, 378.1–378.4
See application file for complete search history.

(56) References Cited

U.S. PATENT DOCUMENTS

| | | | | |
|---|---|---|---|---|
| 6,364,237 | B1 * | 4/2002 | Kagel | 242/379 |
| 7,222,812 | B2 * | 5/2007 | Chang et al. | 242/378.1 |
| 7,364,109 | B2 * | 4/2008 | Kuo | 242/373 |
| 7,384,013 | B2 * | 6/2008 | Yen | 242/378 |
| 7,523,883 | B2 * | 4/2009 | Cheng | 242/378 |
| 7,784,727 | B1 * | 8/2010 | Liao | 242/378.1 |
| 8,136,751 | B2 * | 3/2012 | Chen | 242/378.1 |
| 2007/0001046 | A1 * | 1/2007 | Wu | 242/378.1 |

* cited by examiner

*Primary Examiner* — Sang Kim

(57) ABSTRACT

An automatic positioning winder comprising a lower cover, an upper cover fixed to said lower cover, a winding device provided between said lower and upper covers, entering and outgoing line holes formed in the lateral walls of the lower and upper covers respectively; characterized in that: said winding device consists of a center pillar provided in center of an upper portion of the lower cover, a turning wheel sleeved on the center pillar, a brake component provided in the upper portion of the lower cover and a vulture spring fixed inside of the turning wheel; an annular groove having a flat bottom is formed on the bottom portion of the turning wheel; said annular groove includes a positioning device for forming a guiding groove inside the annular groove; the brake component has a hook portion moving relatively along said guiding groove as the turning wheel rotating.

4 Claims, 4 Drawing Sheets

AUTOMATIC POSITIONING WINDER

This application is a divisional application of U.S. patent application Ser. No. 12/936,515, which is PCT Publication No. WO2009/140,860 A1 entering U.S national phase, and is pending.

FIELD OF THE INVENTION

Description of Prior Art

Most electronic devices are equipped with cables for transmitting electricity or data. Those devices improve our life, however, unorganized cables become a problem. They are easily to get tangled, causing difficulty when separating a device from others or raising safety issues as they may cause accident. Therefore, the cable winder is utilized to store and adjust the cable of the electronic device.

Conventional cable winder uses a coil spring to generate a force for retracting the cable. Some cable winders includes a ratchet mechanism or a backstop member for providing a positioning feature, such as the cited reference 1, CN 200520018519.9, entitled "Two-way Cable Winder".

Another mechanism is also selected for positioning the cable. Said mechanism includes a turning wheel, a hook or stop member and a predetermined track. When the cable is extending or retracting, the wheel rotates, driving said hook member to move along the predetermined track. Multiples positioning holes are preset on the track to allow the hook member engage the hole temporally, providing positioning feature. Such mechanism is disclosed in the cited reference 2, CN 200420102869.9, entitled "An Automatic Wire Winder" and cited reference 3, CN 20072018531.0, entitled "A Wire Winder".

Unfortunately, winding mechanisms disclosed in the documents possesse defect. For example, in the cited reference 3, a roller ball as a stop member, moves within a track with raceways of different heights to achieve the positioning feature. The raceways are set in different heights for changing the moving directions of the roller ball. The stop member impacting the raceways generates noise and can also damage both the raceways and stop member eventually. Therefore, to design a device for retracting cable automatically with quietness and durability has become the main objective of the present invention.

SUMMARY OF THE INVENTION

The present invention, wherein an automatic positioning winder comprising a lower cover (1), an upper cover (2) fixed to said lower cover (1), a winding device provided between said lower (1) and upper covers (2), entering and outgoing line holes (10, 11) formed in the lateral walls of the lower and upper covers respectively. Said winding device consists of a centre pillar (34) provided in center of an upper portion of the lower cover (1), a turning wheel (4) sleeved on the centre pillar (34), a brake component (50) provided in the upper portion of the lower cover (1) and a spiral spring (6) fixed inside of the turning wheel. An annular groove (7) with a flat bottom is formed on the bottom portion of the turning wheel (4). Said annular groove (7) includes pluralities of positioning devices (8) for forming guiding groove (9) inside the annular groove (7). The brake component (50) has a hook portion (500) moving along said guiding groove (9) against rotation of the turning wheel (4); said guiding groove (9) includes a flat bottom and the hook (500) of said brake component moves along the lateral wall of the guiding groove (9) to change moving direction; a circular convex portion (14) and a wedge shape convex portion (15) are provided in the guiding groove (9), forming an outer raceway (17) and an inner raceway (18); said circular (14) and wedge shape (15) convex are spaced by an inlet channel (19) and an outlet channel (20), and an end of the wedge shape convex (15) includes a concave opening (21) connecting the outlet channel (20) A turning radius (R1) of said inlet channel is greater than a turning radius (R2) of an inner side of a tip end of the opening (21) and a turning radius (R3) of the concave opening (21) is greater than a turning radius (R4) of an inner side of a tip end, where is close said outlet channel, of said circular convex (14).

The turning wheel (4) has a compartment (41) on a bottom thereof for accommodating said brake component (50) within and said hook (500) is extended from a groove (42), disposed on the bottom of the wheel (4), and engaged with the guiding groove (9).

Said brake component (5) comprising an elongated arm portion (501), a circular portion (502) and said hook portion (500), which is perpendicular with the circular portion (502).

Four lateral walls and both upper and lower face of said compartment (41) are set to restrain movement of the circular portion (502) of the brake compartment (50).

In contrast of aforementioned cited documents, the brake component disclosed in the present invention is attached onto the turning wheel and having the guiding groove set on the lower cover; moreover, the shapes and structure selected for the brake component can improve the performance thereof.

In conclusion, the brake component of the present invention is moving relatively along the lateral wall of the guiding groove by inertia, thus no step-like structure is needed to apply to the groove for changing the moving direction of the brake component. It avoids the brake component impacting the groove as falling, eliminating the noise and prolonging the service life of the cable winder.

DETAILED DESCRIPTION OF PREFERRED EMBODIMENTS

The preferred embodiments of the present invention are described according appended drawings hereinafter.

Figure 1:
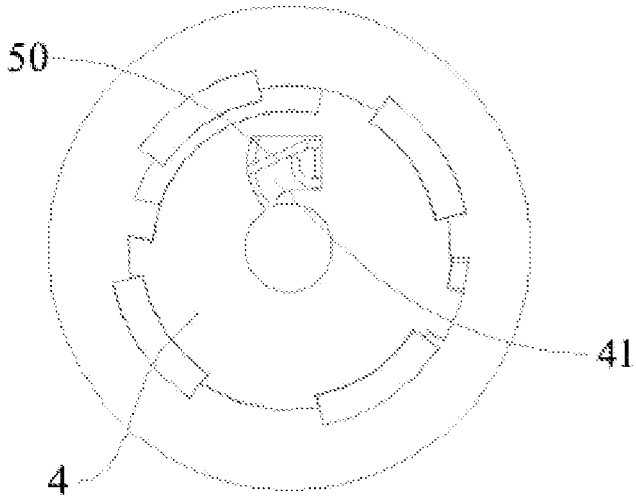
FIG. 1 is a perspective view of the present invention.
Figure 2:
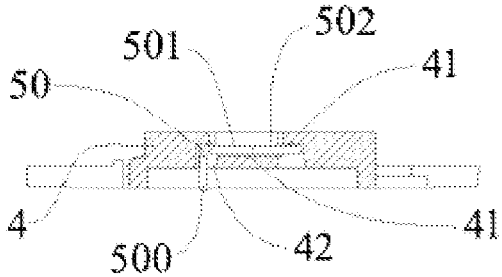
FIG. 2 is a cross sectional view of the turning wheel of the present invention.
Figure 3:
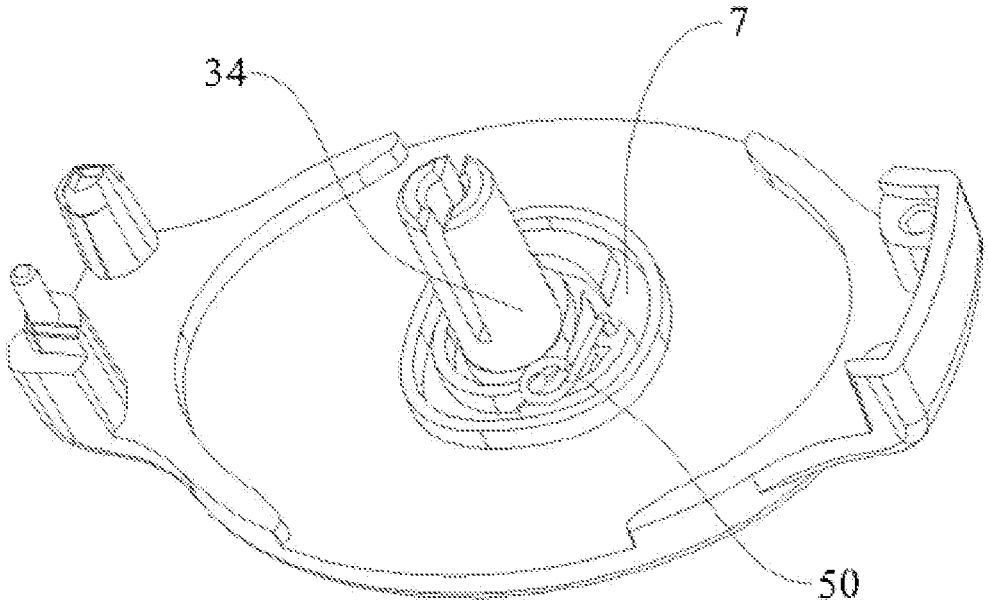
FIG. 3 is a perspective view of the lower cover and brake component of the present invention.
Figure 3:
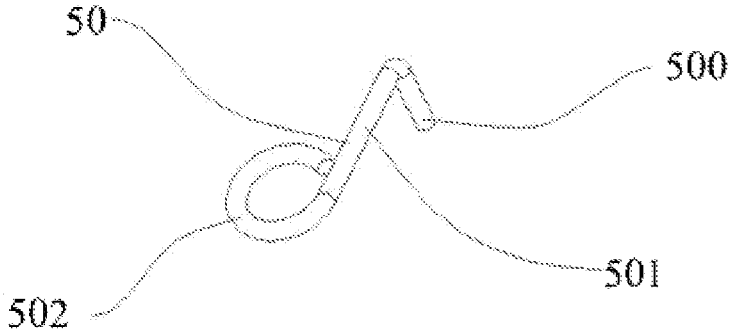

The present invention is disclosed referring to FIGS. 1-3, which reveals an automatic positioning winder comprising a lower cover (1), an upper cover (2) fixed to said lower cover (1), a winding device provided between said lower (1) and upper covers (2), entering and outgoing line holes (10, 11) formed in the lateral walls of the lower and upper covers respectively; characterized in that: said winding device consists of a central pillar (34) provided in center of an upper portion of the lower cover (1), a turning wheel (4) sleeved on the central pillar (34), a brake component (50) provided in the upper portion of the lower cover (1) and a vulture spring (6) fixed inside of the turning wheel (4); an annular groove (7) having a flat bottom is formed on the bottom portion of the turning wheel (4); said annular groove (7) includes a positioning device (8) for forming a guiding groove (9) inside the annular groove (7); the brake component (50) has a hook portion (500) moving relatively along said guiding groove (9) as the turning wheel (4) rotating; said guiding groove (9) includes a flat bottom and the hook (500) of said brake component moves along the lateral wall of the guiding groove (9) to change its moving direction; a circular convex portion (14) and a wedge shape convex portion (15) are provided in the guiding groove (9), forming an outer raceway (17) and an inner raceway (18); said circular (14) and wedge shape (15) convex are spaced by an inlet channel (19) and an outlet channel (20), and an end of the wedge shape convex (15) includes a concave opening (21) connecting the outlet channel (20); said brake component (50) has an elongated post-like shaped, not a spherical shape as disclosed previously, and the guiding groove (9) is provided at a different place, and been attached to the bottom of the turning wheel (40) and said annular groove (7), positioning device (8) and guiding groove (9) are set in an inner face of the lower cover (1).

The turning wheel (4) has a compartment (41) on a bottom thereof for accommodating said brake component (50) within and said hook (500) is extended from a groove (42), disposed on the bottom of the wheel (4), and engaged with the guiding groove (9).

Said brake component (50) comprising an elongated arm portion (501), a circular portion (502) for allowing the component (50) can rotate freely and said hook portion (500), which is perpendicular with the circular portion (502). The hook portion (500) functions as same as said spherical shaped brake component (5), thus no detail function is described herein.

Figure 4:
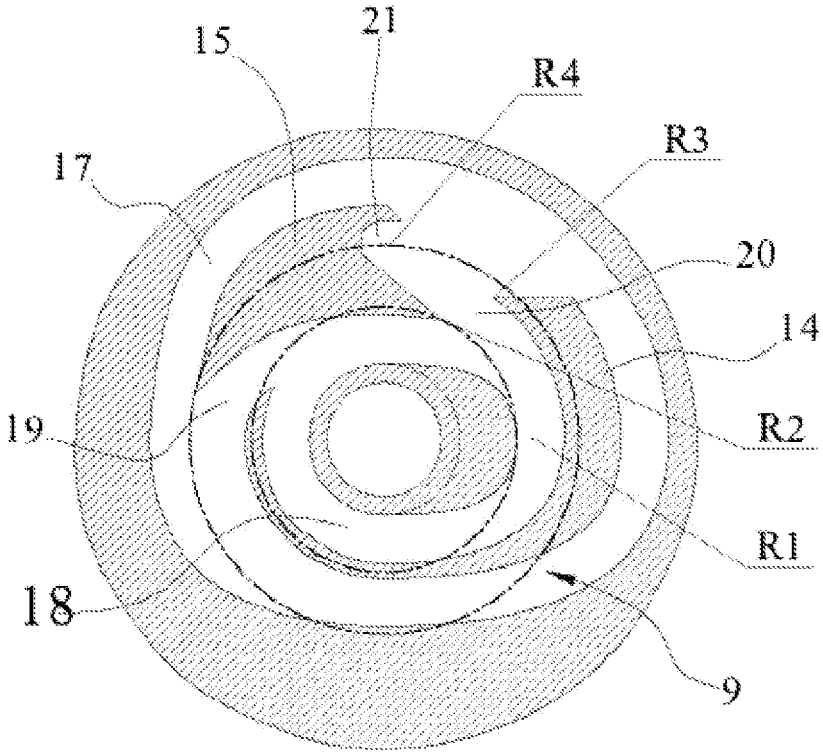
FIG. 4 is an illustrative view of guiding channel of the present invention.
Figure 5:
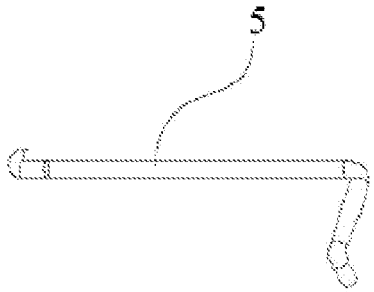
FIG. 5 is a perspective view of the brake component having a L-shape.
Figure 6:
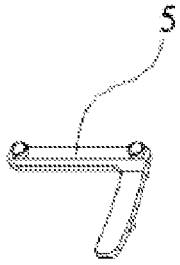
FIG. 6 is another perspective view of the brake component having a L-shape
Figure 7:
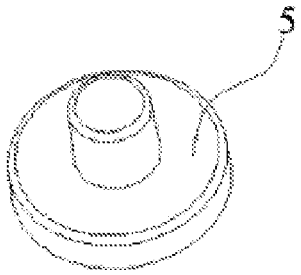
FIG. 7 is a perspective view of the brake component having a cylindrical shape.
Figure 8:
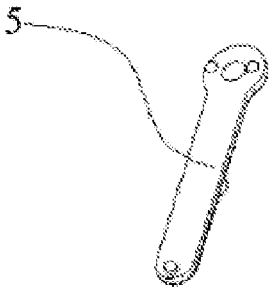
FIG. 8 is a perspective view of the brake component having an elongated shape.

As show in FIG. 4, the bottom of the guiding groove (9) is flat; the hook (500) changes its moving direction by sliding along the side wall of the guiding groove (9). A circular convex portion (14) and a wedge shape convex portion (15) are provided in the guiding groove (9), forming an outer raceway (17) and an inner raceway (18). The circular (14) and wedge shape (15) convex are spaced by an inlet channel (19) and an outlet channel (20), and an end of the wedge shape convex (15) includes a concave opening (21) connecting the outlet channel (20). Said guiding groove (9) has a rotating centre (0), and a turning radius (R1) of said inlet channel is greater than a turning radius (R2) of an inner side of a tip end of the opening (21) and a turning radius (R3) of the concave opening (21) is greater than a turning radius (R4) of an inner side of a tip end of said circular convex (14), which is close to said outlet channel.

The brake component (50) is preferably made of steel. Furthermore, to avoid said hook-like brake component (50) disengages from the guiding groove (9) by external force applied to the device, four lateral walls and both upper and lower face of said compartment (41) are set to restrain movement of the circular portion (502) of the brake component (50).

Besides the spherical and a hook-like shape, the shape of said brake component (5) can also be selected from a L-shape, a cylindrical shape and an elongated shape as shown in FIGS. 5-8.

The guiding groove (9), disposed at bottom of the turning wheel (4), is designed using the inertia force to allow the brake component (5, 50) of both embodiments travel within the outer and inner raceways (17, 18), which are provided concentrically encircling the centre of the lower cover (1). The present invention has been described via the detailed illustration of the preferred embodiments. Those skilled in the art can derive variations from the preferred embodiment without departing from the scope of the present invention, for example the shapes of the outer and inner raceways (17, 18), the brake component (5) and the raceway (32). Therefore, the preferred embodiment shall not limit the scope of the present invention defined in the claims.

The invention claimed is:

1. An automatic positioning winder comprising a lower cover (1), an upper cover (2) fixed to said lower cover (1), a winding device provided between said lower (1) and upper covers (2), entering and outgoing line holes (10, 11) formed in the lateral walls of the lower and upper covers respectively; characterized in that: said winding device consists of a central pillar (34) provided in center of an upper portion of the lower cover (1), a turning wheel (4) sleeved on the central pillar (34), a brake component (50) provided in the upper portion of the lower cover (1) and a vulture spring (6) fixed inside of the turning wheel (4); an annular groove (7) having a flat bottom is formed on the bottom portion of the turning wheel (4); said annular groove (7) includes a positioning device (8) for forming a guiding groove (9) inside the annular groove (7); the brake component (50) has a hook portion (500) moving relatively along said guiding groove (9) as the turning wheel (4) rotating; said guiding groove (9) includes a flat bottom and the hook (500) of said brake component moves along the lateral wall of the guiding groove (9) to change its moving direction; a circular convex portion (14) and a wedge shape convex portion (15) are provided in the guiding groove (9), forming an outer raceway (17) and an inner raceway (18); said circular (14) and wedge shape (15) convex are spaced by an inlet channel (19) and an outlet channel (20), and an end of the wedge shape convex (15) includes a concave opening (21) connecting the outlet channel (20); a turning radius (R1) of said inlet channel (19) is greater than a turning radius (R2) of an inner side of a tip end of the opening (21) and a turning radius (R3) of the concave opening (21) is greater than a turning radius (R4) of an inner side of a tip end of said circular convex (14), which is close to said outlet channel (20).

2. The automatic winder of claim 1, wherein the turning wheel (4) has a compartment (41) on a bottom thereof for accommodating said brake component (50) within; said hook (500) is extended from a groove (42), disposed on the bottom of the wheel (4), and engaged with the guiding groove (9).

3. The automatic winder of claim 2, wherein said brake component (50) comprising an elongated arm portion (501), a circular portion (502) for providing freely rotation and said hook portion (500), which is perpendicular with the circular portion (502).

4. The automatic winder of claim 3, wherein four lateral walls and both upper and lower face of said compartment (41) are set to restrain movement of the circular portion (502) of the brake component (50).

* * * * *